US006742732B1

(12) United States Patent
Hundt et al.

(10) Patent No.: US 6,742,732 B1
(45) Date of Patent: Jun. 1, 2004

(54) ADJUSTABLE FEEDING AND STRIKING RAMP

(76) Inventors: Vincent G. Hundt, N591 Co. PI, Coon Valley, WI (US) 54623; James O. Brick, 23661 Hwy. 4, Paynesville, MN (US) 56362

( * ) Notice: Subject to any disclaimer, the term of this patent is extended or adjusted under 35 U.S.C. 154(b) by 21 days.

(21) Appl. No.: 10/045,702

(22) Filed: Jan. 11, 2002

(51) Int. Cl.[7] ..... B02C 13/286

(52) U.S. Cl. ..... 241/28; 241/32; 241/73; 241/186.3; 241/223

(58) Field of Search ..... 241/222, 223, 241/224, 186.3, 285.3, 28, 32, 73

(56) References Cited

U.S. PATENT DOCUMENTS 2,954,176 A * 9/1960 Cole ..... 241/186.3
4,355,557 A 10/1982 Mecsey
4,554,958 A 11/1985 Schmidt
5,419,502 A 5/1995 Morey
5,427,162 A 6/1995 Carter
5,657,933 A * 8/1997 Williams ..... 241/186.3
5,975,443 A * 11/1999 Hundt et al. ..... 241/189.1
6,056,485 A 5/2000 Magill et al.
6,207,228 B1 3/2001 Hundt et al.

* cited by examiner

*Primary Examiner*—Mark Rosenbaum
(74) *Attorney, Agent, or Firm*—M. Paul Hendrickson

(57) ABSTRACT

The present invention relates to an adjustable feeding and striking ramp which permits for adjusting an angular disposition of feed material fed to an impacting radial pathway of shearing teeth carried by a rotor. By adjusting the feeding and striking ramp to a predetermined striking position, fragmenting efficacy may be significantly enhanced while also substantially reducing fouling.

17 Claims, 9 Drawing Sheets

ADJUSTABLE FEEDING AND STRIKING RAMP

FIELD OF THE INVENTION

The present invention relates to an adjustable feeding and support ramp for rotary fragmenting machines and, more particularly, to an adjustable feed ramp for adjusting an angular positioning of feed material fed and supportively fragmented by a fragmenting rotor equipped with breaking teeth, and the use thereof.

BACKGROUND OF THE INVENTION

Rotating fragmenting machines equipped with a rotor and radially positioned shearing teeth such as disclosed in U.S. Pat. Nos. 6,207,228 B1 and 5,975,443 rely upon a striker bar at a fixed radial positioning relative to the breaker teeth and feed material fed thereto. The feed material is partially fragmented or ground upon impacting of the rotating breaker teeth against the material supported upon a fixed striker bar. These machines will on occasion be inadvertently fed with an ungrindable material, such as a steel wrecking bar, which can cause machine damage or stop the drive motors. This problem led to a break-away carriage and screen assembly improvement of U.S. Pat. No. 5,975,443 which permits separation of a cradled screen and rigidly attached striker bar from the impacting rotor upon exposure to excessive shearing conditions. Although the break-away carriage and screen assembly of U.S. Pat. No. 5,975,443 does not materially affect machine fouling, it prevents excessive machine damage, especially when ungrindable feed materials are fed or lodged within the fragmenting chamber.

It has been unexpectedly discovered that the characteristics and properties of the feed materials fed to the rotating breaker teeth materially effect the fragmenting efficacy and fouling propensity of the fragmenting machine. It has been further discovered that by adjusting the angular disposition and support of the feed materials relative to the radial path of the striking breaker teeth rotating about a rotor, the fouling problem may be effectively alleviated for almost all applications. Thus, by predetermining the optimum radial positioning for any given feed material and adjusting the angular feed and support positioning to a predetermined setting for any given feed material, the fouling of feed material within the fragmenting zone of the rotary fragmenting machine may be effectively alleviated. This may be accomplished by providing a radially adjustable feeding and striking ramp, preadjusted to a predetermined angular position, which ramp serves as an impacting or supporting anvil in juxtaposition to the rotating teeth. The adjustable ramp permits radial adjustments to the proper radial disposition for any given material being fed and stricken by the rotating teeth. The less tenacious materials (e.g. soft woods) which splinter relatively easily may be processed at a more aggressive setting or impacting angle than those materials of a more tenacious and stringy character, such as the more fibrous types of woods, as typified by cottonwood, poplar, etc. Feed stock of longer lengths are sometimes more prone to fouling and may require a less aggressive setting than feed stock of shorter lengths.

The fragmenting machines are frequently mounted upon a semi-trailer and transported to various different processing sites for processing various types of different materials. Periodically the fragmenting machines are fouled by the feed material. The fouled materials typically require removal from the fouled machine and a repositioning of the releasable carriage assembly to an operative position in order to continue processing.

SUMMARY OF THE INVENTION

Feed materials fragmented by fragmenting machines equipped with rotating shearing teeth are conventionally fed to the fragmenting zone at a fixed angular positioning relative to the shearing teeth. The present invention provides an adjustable feeding and striking ramp for adjusting an angular disposition of feed material being fed onto a radial pathway of shearing teeth carried cylindrical drum or rotor of a fragmenting machine. This may be accomplished through use of a pivotally mounted feeding and striking ramp which may be angularly adjusted to a preadjusted angular positioning relative to a radial pathway as generated by the rotating shearing teeth. This permits the angular disposition of the feed material to be adjusted to a predetermined supportive striking position so as to optimize the fragmenting efficacy of the fragmenting machine and to alleviate machine fouling.

DETAILED DESCRIPTION OF THE INVENTION

The present invention provides an adjustable feeding and striking ramp (generally designated as 80) which serves as an adjustable feeding anvil for feeding feed material F (e.g. waste wood, plastics, etc.) to the breaking or shearing action of fragmenting teeth 41 carried by a rotor 4 about a fixed axis $\mathbf{42}_S$ in a fragmenting machine 1.

Figure 3:
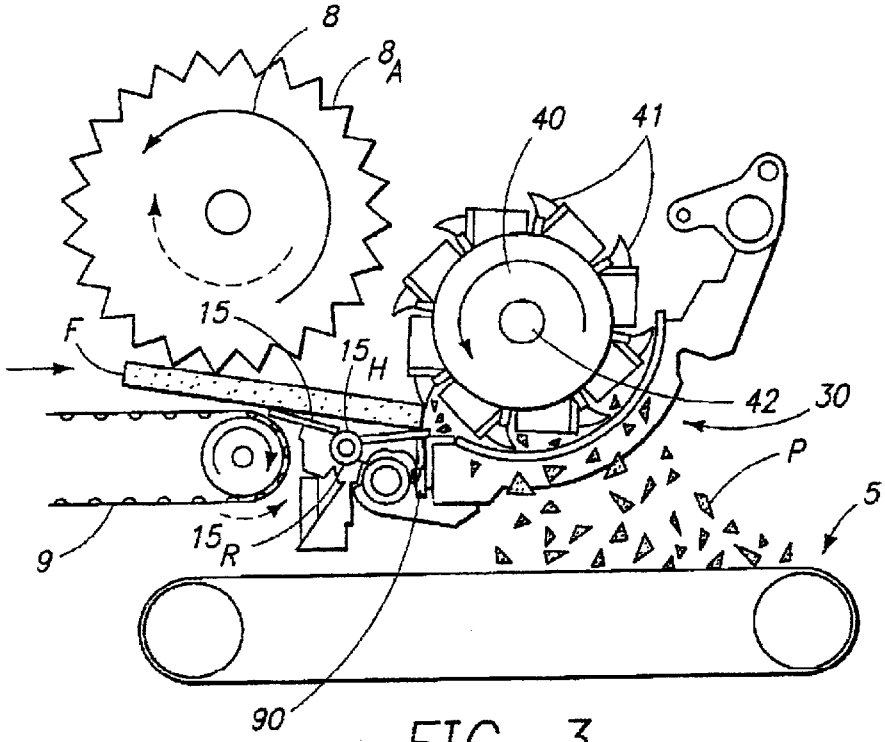
FIG. 3 is a partial cross-sectional view of the adjustable feeding ramp shown in FIG. 2 depicting feed material being fed to the impacting teeth at a lowered ramping position.
Figure 4:
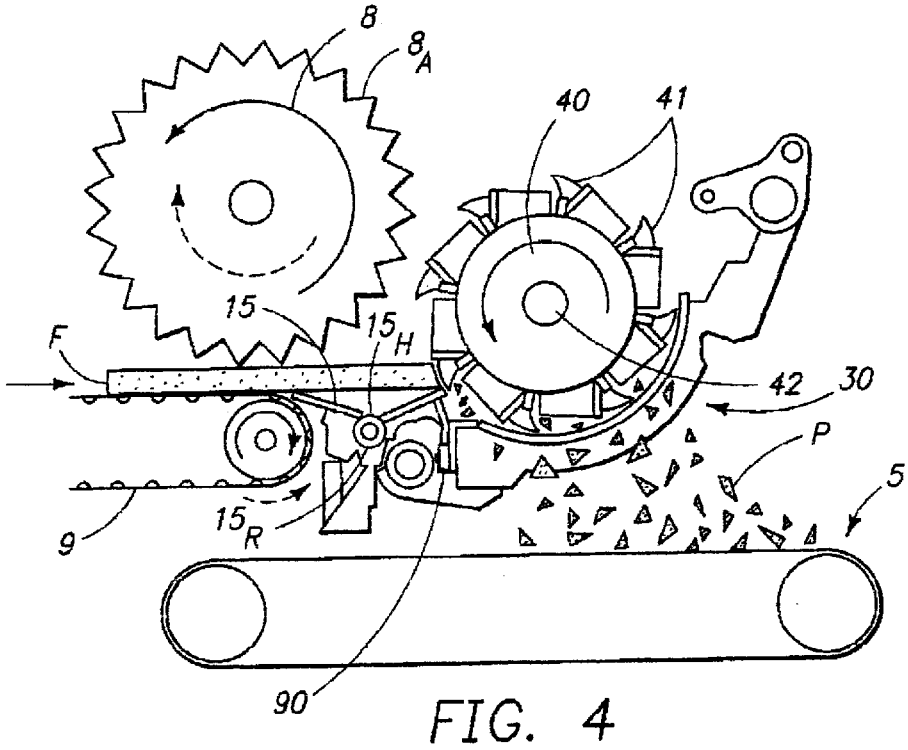
FIG. 4 is a cross-sectional view of FIG. 3 showing the adjustable feeding ramp of FIG. 3 adjusted to an elevated ramping position.
Figure 5:
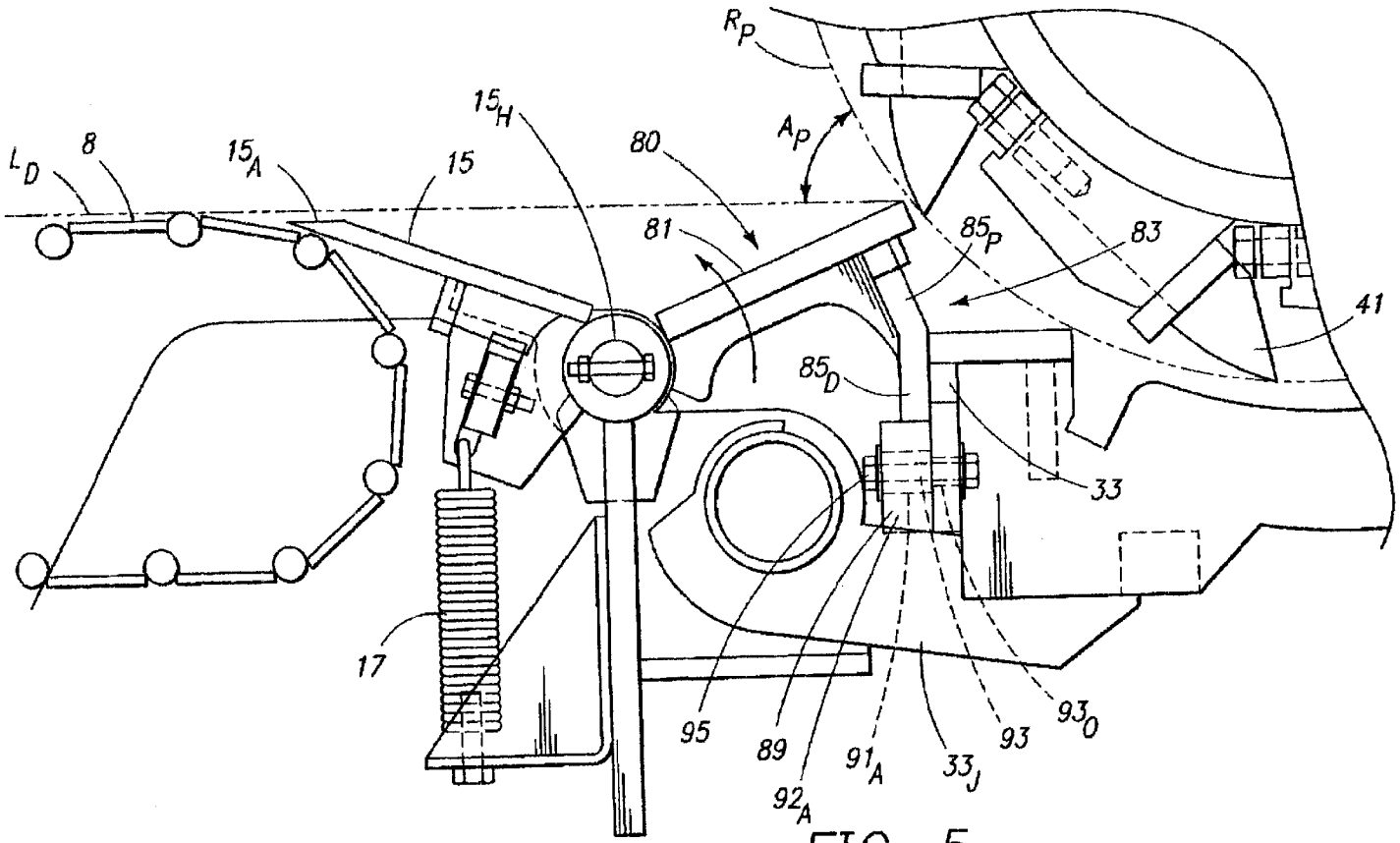
FIG. 5 is an enlarged view of the adjustable feeding ramp shown in FIG. 4.
Figure 7:
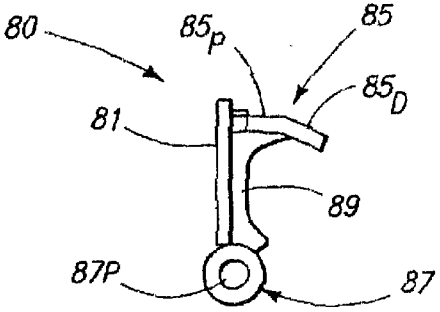
FIG. 7 is a side view of the unassembled adjustable feeding ramp shown in FIG. 6.
Figure 8:
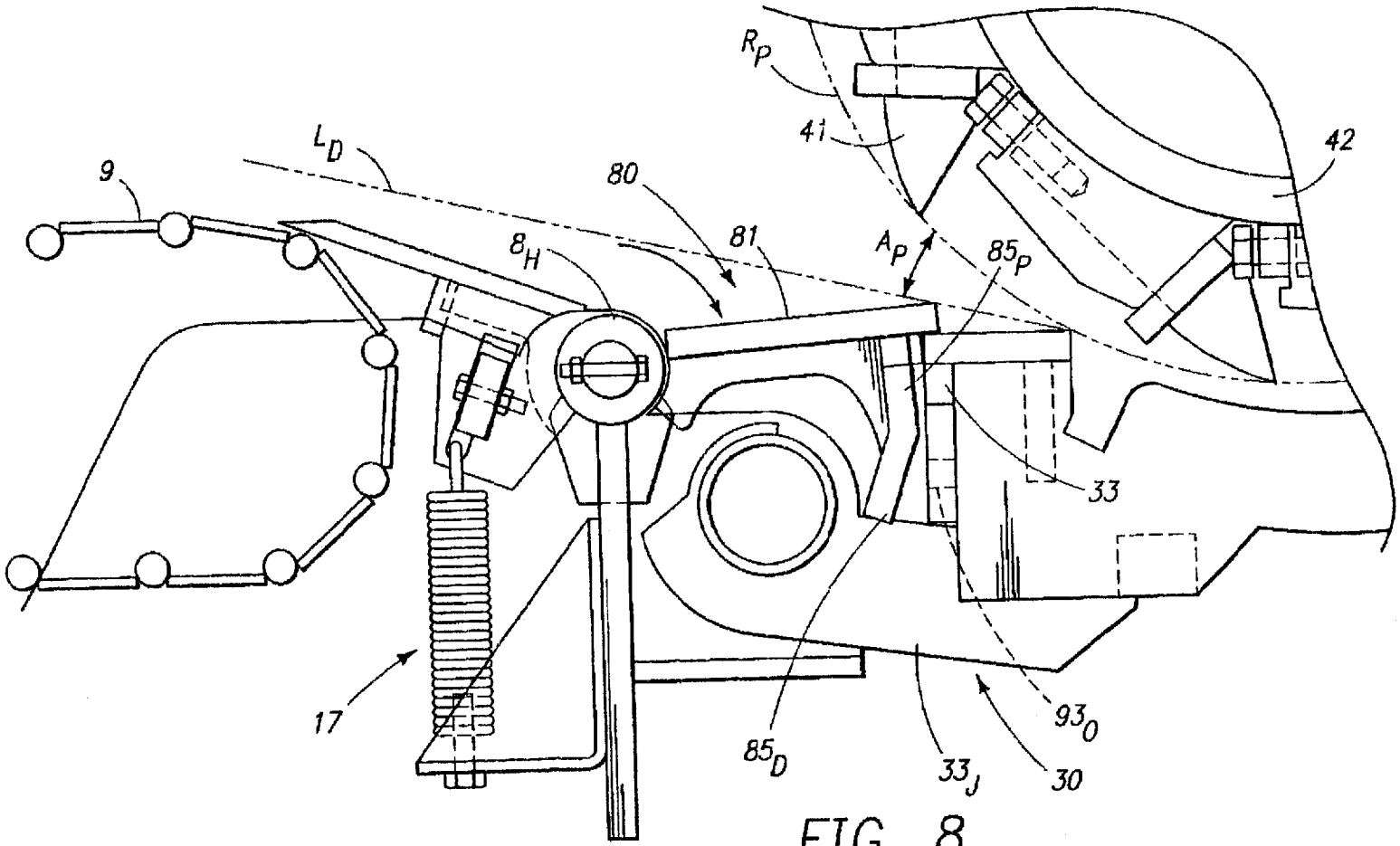
FIG. 8 is an enlarged side view of FIG. 3 depicting the adjustable feeding ramp in the down position.

An important aspect of the invention is to provide an adjustable feeding and striking ramp 80 for adjusting an angular impacting disposition of feed material F fed onto a radial pathway $R_P$ of shearing teeth 41 rotationally carried about a cylindrical drum 42 or rotor of fragmenting machine 1. The adjustable feeding and striking ramp 80 may be comprised of a rigid ramping section 81 pivotally mounted $\mathbf{8}_H$ at a feed end so as to permit the ramp section 81 to be pivotally adjusted to a predetermined ramping and striking position (particularly as illustrated in FIGS. 3–5 and 8) for ramping feed material F onto the radial pathway $R_P$ of the shearing teeth 41 and retaining means (generally referred to as 83) for retaining the ramp section 81 at the predetermined ramping position for the feeding of feed materials F onto the striking radial pathway $R_P$ of the shearing teeth 41. By adjusting the ramping section 81 to a predetermined ramping feed and striking position, the angular striking disposition $A_P$ of any particular feed material may be accordingly adjusted so as to enhance fragmenting efficacy and to reduce feed machine fouling. The angular disposition $A_P$ is the radial arc between the juncturing site at which the impacting teeth strikes the feed material and the closest situs between the distal top edge of ramp section 81 and the rotating teeth 41. The angular disposition $A_P$ increases as the distance between the leading edge of plate section 81 and the radial pathway $R_P$ increases. As shown in FIGS. 3 and 8, when plate section 81 is unelevated, the feed material F bridges between plate section 81 and striker bar 33 with the substantial feed support occurring upon the striker bar 33. When elevated the dominate support is by plate section 81 as shown in FIGS. 4 and 8. The ramp section 81 may be appropriately equipped to provide variable or multiple-staged ramping adjustments as depicted in the figures. The ramping adjustments may be manual or automated. FIGS. 5 and 8 illustrate the difference in the angular disposition $R_P$ (also referred to hereinto as the radial feed positioning of feed material F fed to the radial pathway $R_P$ of the striking teeth. The dotted line $L_D$ (plane of feed) depicts the radial positioning or angular disposition of feed material fed as it intercepts the radial pathway $R_P$ of the rotating teeth. As ramp 80 is elevated (e.g. see FIG. 5), an extension of dotted line $L_D$ through pathway $R_P$ to form a chord creates a longer chord than if dotted line $L_D$ is extended in the unelevated position as shown in FIG. 8.

Different types of feed materials have different fragmenting characteristics. Dimensional, as well as inherent product characteristics, affect fragmentation. Stringy type woods, such as green poplar and cottonwood, are susceptible to incomplete grinding and tend to be pulled into the fragmenting zone by the impacting teeth 41 in a substantially intact form and may become lodged between the rotating rotor 40 and the cradled screen assembly 43. This leads to ineffective fragmenting and screening of the processed product, as well as machine fouling. By adjusting the angular position of the striking teeth 41 against the feed material F, the screening and machine fouling problem can be effectively controlled. By elevating the support site at which the impacting teeth 41 strike or bite into the feed material F, the angle at which the striking teeth 41 attack the feed material F is altered so as to permit the striking teeth 41 to chip away at the feed material F at the optimum fragmenting rate for any given particular feed material F.

The rate at which the feed material F is fed into the fragmenting zone 4 is also adjusted by the positioning of the adjustable feeding and striking ramp 80. The lower ramping level increases both the feed rate and the aggressiveness of the bite by the striking impacting teeth 41. Raising the adjustable feeding and striking ramp 80 decreases feed rate and the depth of bite by the striking teeth into the fed material F as it is fed and supported upon feed plate section 81. Amongst the wooded materials, thin hickory boards or slabs are also particularly prone to machine fouling when the feeding and striking ramp 80 is placed in the lowered ramping position as depicted in FIG. 3. When placed in the elevated position or angular position as depicted in FIG. 4, optimum grinding efficacy and substantial alleviation of the hickory board machine fouling are achieved. Other feed materials, such as plastics, paper, sheeting, etc., all possess inherent grinding attributes (size, hardness, breaking strength, cleaving ease, elasticity, tenaciousness, etc.) which possess an optimum angular impacting disposition for feeding and striking of the respective feed materials with the impacting teeth 41.

The adjustable feeding and striking ramp assembly 80 is particularly well suited for use in what is referred to as a waste cycling device 1 equipped with a floating stripper plate 15, a discharge plate $\mathbf{15}_B$, a striker bar 33 and a releasable cradle assembly 30 as disclosed in U.S. Pat. No. 5,975,443 to Vincent G. Hundt, et al. Such releasable cradle assembly 30 includes a shear releasing means for disengaging a striker bar 33 supported by the releasable cradle assembly 30 from a fragmenting position in the event the striker bar 33 of the cradle frame 31 should be exposed to an excessive shearing force. In operational use, feed materials are fed to a fragmenting zone 4 by power feeding means (generally referenced as 3) powered by feed motor $M_F$ in cooperative association with power feed 8 powered by power feed motor $M_N$. A rotary motor $M_R$ serves as a power source for powering a fragmenting rotor 40. A discharging motor $M_D$ serves as a power source for powering a discharging means (generally designated as 5) for conveying processed products D from machine 1. The fragmenting machine 1, as disclosed in U.S. Pat. No. 6,207,228B1, includes impacting and shearing teeth 41 which rotate about cylindrical rotor 42 and exert a downwardly and radially outward, pulling and shearing action upon the feed material F as it is fed onto a striking bar 33 and sheared thereupon by the shearing teeth 41. The orbital shearing teeth 41 project outwardly about an orbital or radial pathway $R_P$ from a cylindrical rotor 42 which is typically rotated at operational speeds of about 1800–2500 r.p.m. Rotor 42 is driven about power shaft $\mathbf{42}_S$. The rotating teeth 41 intercept the feed material at the radial pathway $R_P$ and create a turbulent flow of the fragmented feed materials within the fragmenting zone 4.

Figure 1:
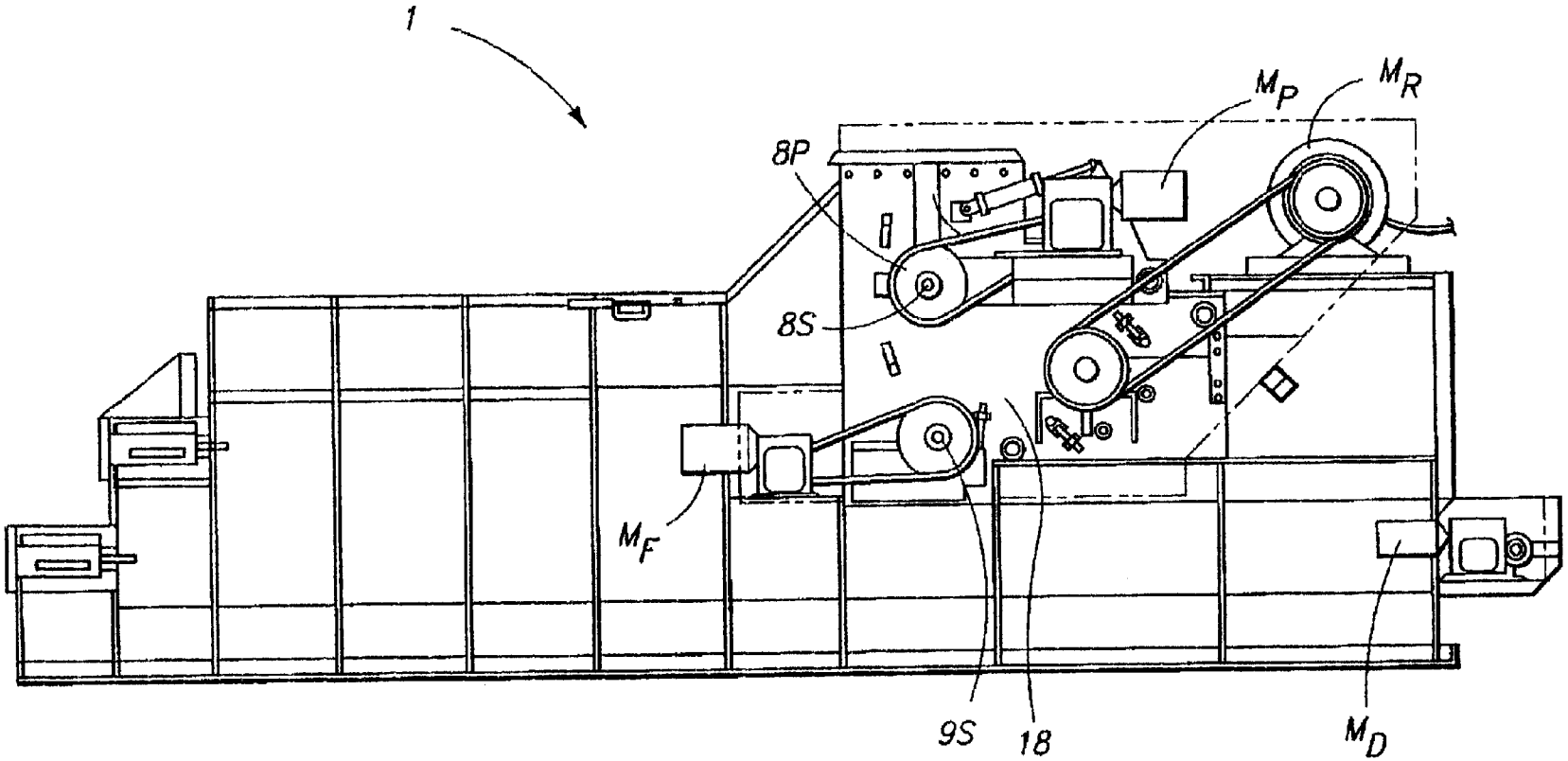
FIG. 1 is an external side view of a fragmenting machine internally equipped with the adjustable feeding ramp of this invention.
Figure 2:
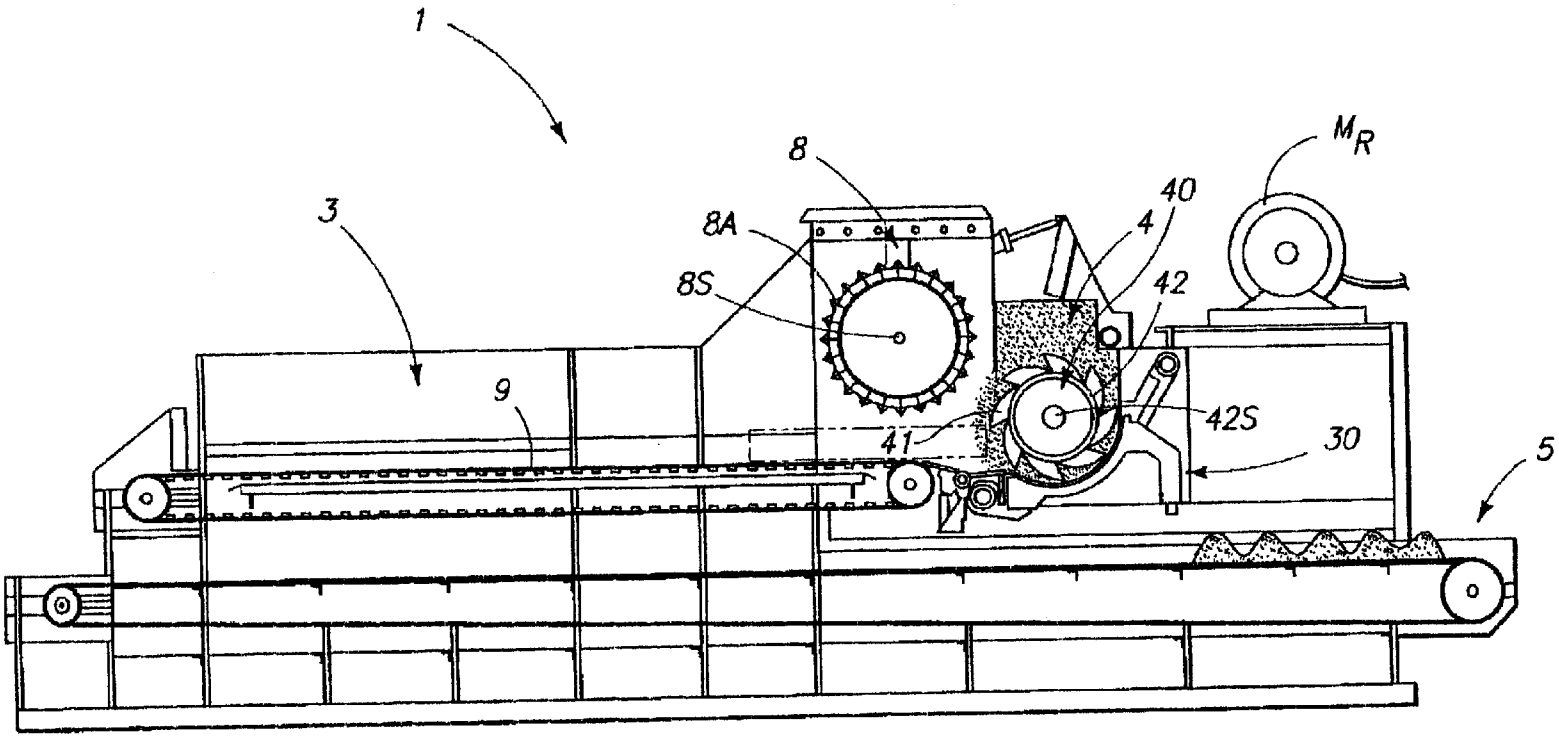
FIG. 2 is a bisectional cross-section side view of FIG. 1.
Figure 6:
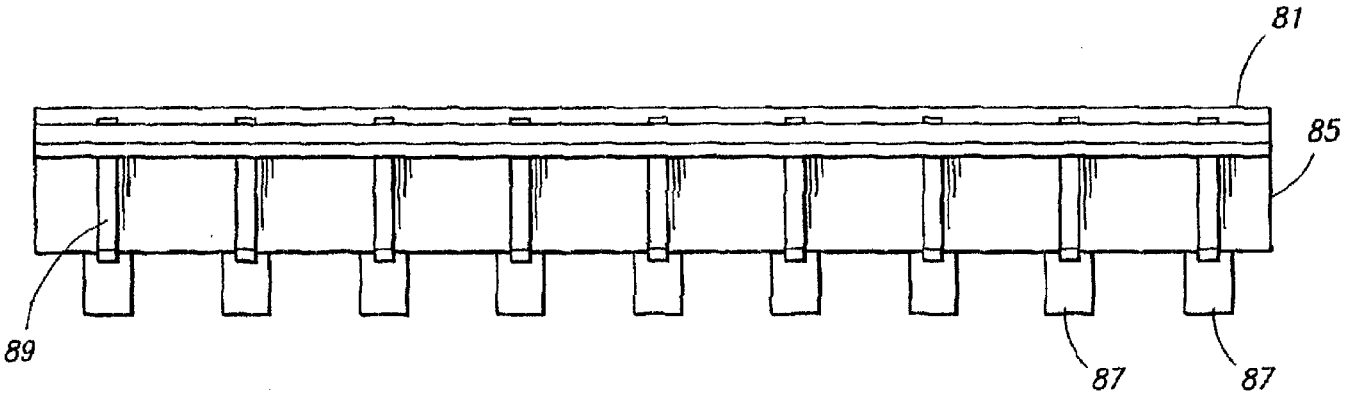
FIG. 6 is an unassembled bottom view of the adjustable feeding ramp shown in FIG. 5.

As described and shown in U.S. Pat. No. 5,975,443, such fragmenting machines are typically equipped with a power feeder (designated in general as 8), which in cooperative association with apron 9 and distributor plate $\mathbf{15}_D$, uniformly feeds and distributes feed material such as waste bulk to fragmenting zone 4 for fragmentation by the breaker teeth of fragmenting rotor 40 at a fixed striking position. The power feeder 8, as illustrated, contains a series of projecting feeding teeth $\mathbf{8}_A$ positioned for counterclockwise rotational movement upon power drum $\mathbf{8}_D$ driven about feed shaft $\mathbf{8}_S$ sprocket $\mathbf{8}_P$, and motor $M_P$. The fragmenting machine includes a cleaning assembly 13 for cleaning debris from conveying apron 9, as depicted in U.S. Pat. No. 5,975,443 and FIG. 9 herein. The assembly 15 typically includes an adjustable floating stripper plate 15 equipped with a scraper blade $\mathbf{15}_A$ which tangentially contacts against continuous apron 9 and scrapes feed or waste residue from apron 9. As shown by the cross-sectional views of FIGS. 2, 6 and 9 of the Hundt, et al U.S. Pat. No. 5,975,443 and FIG. 5 herein, stripper plate 15 and its scraper blade $\mathbf{15}_A$ extends crosswise across the entire width of apron 9.

Figure 9:
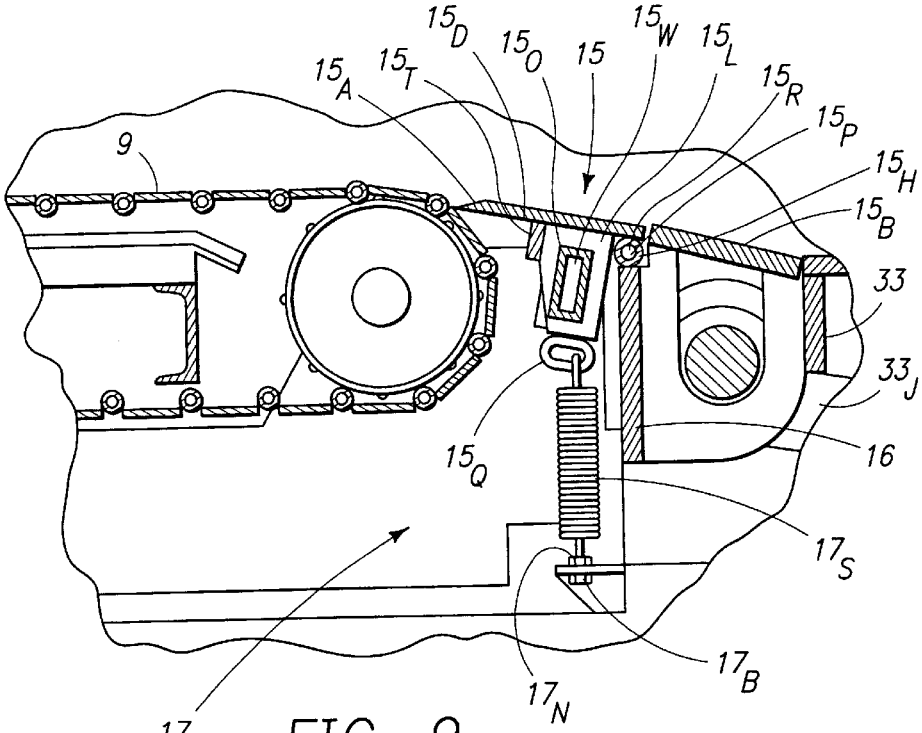
FIG. 9 Prior Art
FIG. 9 is a projected side view of FIG. 5 of U.S. Pat. No. 5,975,443 depicting a discharging plate which has not been retrofitted with the adjustable feeding and striking ramp assembly embodiments of this invention.

The cleaning assembly 15, as illustrated in the Hundt, et al patent and FIG. 9 herein, includes an adjustable biasing means 17 for adjusting the amount of tension applied by the stripper plate 15 against apron 9. The stripper plate 15 is designed so as to float along the surface of the apron sections. A stripper plate hinge $\mathbf{15}_H$ (positioned at an opposite end of stripper plate 15 from scraper blade $\mathbf{15}_A$) provides a floating pivotal or axial mount for stripping plate 15. Hinge $\mathbf{15}_H$ is typically constructed in the form of a piano hinge which extends crosswise across the entire width of stripper plate 15. Hinge $\mathbf{15}_H$ may be illustratively constructed of 2" length by ¾" I.D. steel bushing stock $\mathbf{15}_P$ alternately welded to support frame 16 and underside of stripping plate 15 to provide a piano hinge of intermeshing and aligned bushing stock hinges $\mathbf{15}_P$ hinged together by 11/16" O.D. rod stock $\mathbf{15}_R$. The cleaning assembly 15 as depicted in U.S. Pat. No. 5,975,443 also includes two anchor bar hold-down springs $\mathbf{17}_S$ laterally secured at opposing bar $\mathbf{15}_W$ ends by hold-down brackets $\mathbf{15}_L$ by chain links $\mathbf{15}_Q$ directly welded or secured to hold-down brackets $\mathbf{15}_L$. Hold-down spring 17 comprises an adjustable tension spring $\mathbf{17}_S$ equipped with an adjusting bolt $\mathbf{17}_B$ and nut $\mathbf{17}_N$ which permits the tension of spring $\mathbf{17}_S$ to be adjusted to the appropriate stripper plate 15 tension.

The stripping plate 15 and discharge plate $\mathbf{15}_B$ are intermeshingly hinged $\mathbf{15}_H$ in a piano hinge fashion about hinging shaft $\mathbf{15}_R$. In the present invention the feeding and striking ramp 80 with its hinging eyelets 87 are designed to retrofit as a replacement for the discharging plate $\mathbf{15}_B$ of U.S. Pat. No. 5,475,443. The discharging plate $\mathbf{15}_B$ (as opposed to the adjustable feeding and striking ramp herein) collects wastes distributed by distributor plate $\mathbf{15}_D$ and discharges the scraped wastes W onto the striker bar 33. The distributor plate portion $\mathbf{15}_D$ of stripping plate 15 includes a reinforcement bar $\mathbf{15}_T$ and a series of hold-down brackets $\mathbf{15}_L$ fitted with anchor bar apertures $\mathbf{15}_O$ which serve to house a stripper plate anchor bar $\mathbf{15}_W$. Anchor bar $\mathbf{15}_W$ extends across the entire crosswise width of stripping plate 15 and externally protrudes outwardly from covering shell 18 so as to permit a machine operator to make external adjustments of anchor bar $\mathbf{15}_W$. Hold-down brackets $\mathbf{15}_L$ may be fabricated from a series of flat stock plate (e.g. four or more) fitted with aligned anchor bar apertures $\mathbf{15}_O$ for housing and retaining anchor bar $\mathbf{15}_W$. As may be observed from the Figures of U.S. Pat. No. 5,975,443, the distributor plate $\mathbf{15}_D$, scraper blade $\mathbf{15}_A$, hold-down brackets $\mathbf{15}_L$ and anchor bar $\mathbf{15}_W$ freely float about hinge $\mathbf{15}_H$. With anchor bar $\mathbf{15}_W$ being externally fitted with anchor bar adjusting means (generally shown as 17) which, upon tightening, serves to limit the upper movement of stripper plate blade $\mathbf{15}_A$ more firmly against apron 9 and upon untightening to allow a greater clearance of blade $\mathbf{15}_A$ against apron 9. The adjustable anchor bar $\mathbf{15}_W$, when properly adjusted, serves as a safety stop so as to protect both the stripping blade 15 and apron 9 from damage.

An important aspect of the adjustable striking and feeding ramp 80 herein is the ability to adjust the angular striking and pulling action of the rotating teeth 41 as they sweep by a feed material F supported upon ramped section 81. The objectives of this invention may be accomplished by altering the structure and function of the discharge plate $\mathbf{15}_B$, striker bar 33 and the releasable carriage assembly 30 as disclosed in U.S. Pat. No. 5,975,443 (referred to herein as Hundt, et al) to include the adjustable feeding and striking ramp assembly 80 embodiments of this invention. This modification includes replacement of discharge plate $\mathbf{15}_B$ of U.S. Pat. No. 5,975,443 with a pivotally mounted ramp section 81 equipped with adjustable retaining means 83 for retaining the pivotally mounted ramp section 81 at a predetermined ramping and striking position $R_P$. As may be observed, particularly by reference to FIGS. 10 and 11 of U.S. Pat. No. 5,975,443 and FIG. 9 herein (a reproduction, in part, of FIG. 5 of the Hundt, et al Patent), the stripper blade 15 and discharge Plate $\mathbf{15}_B$ in the unmodified fragmenting machine, as disclosed in the Hundt, et al Patent, serve to simply convey the feed material F to breaker plate 33 which, in turn, functions as a fixed supportive anvil or fixed fracturing site for those feed materials F fed to the striking or impacting action of the shearing teeth 41. In the present invention, the discharge plate $\mathbf{15}_B$ as described in U.S. Pat. No. 5,975,443 is replaced with an adjustable feeding and striking ramp 80 which, when elevated to an elevation above the striking bar 33 elevation (as shown in FIGS. 4 and 5), functions as the supportive anvil for feed materials F fed onto the radial pathway $R_P$ of the impacting and fragmenting action of the breaker teeth 41. This modification alters the radial situs at which the fragmenting action by the rotating shearing teeth 41 occurs, as may be further appreciated by a comparison between FIG. 9 herein, (as well as FIGS. 5 and 6 of U.S. Pat. No. 5,975,443). with the adjustable shearing ramp 80 depicted in FIGS. 3–5 and 8 herein. When the feeding and striking ramp 80 rests in an unelevated position as shown in FIG. 8, fragmenting anvil action occurs against both the striker bar 33 and ramp section 81.

The adjustable feeding and striker ramp assembly 80 of this invention is constructed of materials possessing sufficient strength, rigidity and durability so as to serve not only as a feeding ramp, but also as a solid supportive anvil upon which the feed materials F are supported and cleaved by the radial impacting movement created by the sweeping rotating teeth 41 against feed materials F supported thereupon. As may be observed with particular reference to FIGS. 3–8, the depicted adjustable feeding and striking ramp 80 includes a support plate section 81, a downwardly and inwardly extending flange member 85 positioned at a discharging end of the discharging plate section 81, and a series of hinging eyelets 87 fitted with hinging bushings $\mathbf{87}_P$ for hinged engagement onto hinging rod stock $\mathbf{15}_R$ at an inlet end of the support plate section 81. The hinging eyelets 87 are laterally positioned across the inlet side of the feed plate 81 at an intermeshing positioning so as to matingly intermesh with the bushing hinges $\mathbf{15}_P$ of stripper plate 15 and hinge frame support of hinge $\mathbf{15}_H$. This creates a piano hinging of intermeshing feed ramp hinges with the stripper plate hinge assembly $\mathbf{15}_H$.

In operation, the feeding and striking ramp assembly 80 undergoes substantial impacting forces created by the sweeping teeth 41 impacting against the feed material F supported upon the ramp assembly 80. A series of laterally spaced ribs 89 provide structural support to the hinged eyelets 87, as well as the discharging and supportive feed plate section 81 and flanged member 85 upon which the discharging end of the adjustable feeding and striking ramp 80 rests. As may be further observed from FIGS. 6 and 7, each of the feeding ramp hinged eyelets 87 is supported by a series of ribbed support sections 89 which provide supportive bracing bridging between the ramp hinging eyelets 87, the discharging plate section 81 and the flanged member 85. The flanged member 85 includes a proximate flanged segment 85p reflected by a bending slightly inwardly of flanged member 85 in juxtaposition to feed plate section 81 and then a more inwardly projection at a greater angular position beginning at about a mid-section of the flanged member 85 to form a distal section $\mathbf{85}_O$ which is designed so as to provide sufficient clearance from breaker bar 33 when the ramp 80 is raised to an elevated ramp position with the retaining means 90.

The adjustable feeding and striking ramp 80 may be maintained in the elevated position in the simplest form by retaining means 90 of manually inserting blocking material sized so as to raise the discharge end of the adjustable ramp 80 to a desired ramping or radial feed position relative to the arcuate or radial pathway $R_P$ of the rotating breaker teeth 41. In operation, the adjustable feeding and striking ramp 80 serves to support the feed materials F for shearing as opposed to anvil action of the shearing bar 33 of U.S. Pat. No. 6,207,228B1. The elevating blocks (generally referenced as 92) of a desired height may be simply placed beneath the downwardly and laterally extending flanged member 85 of the adjustable feed ramp 80 and upon the leading surface $\mathbf{33}_L$ of the striker bar 33. Constant hammering of the impacting teeth 41 against the feed material necessitates that the retaining means 90 be firmly anchored so as to prevent unwanted slippage from its desired positioning. In a more preferred embodiment of the invention, the elevating blocks 92, after positioning to the appropriate elevational level position, are firmly secured to the fragmenting machine 1 so as to maintain the proper ramping position. By positioning the retaining means 83 for retaining the ramp section 81 at a predetermined ramping position in cooperative association with the releasable cradle assembly 30, potential damage and costly repairs to the fragmenting machine are substantially alleviated by providing an adjustable but releasable feeding and striking ramp 80 which also enhances the fragmenting efficacy and over-all operation of the fragmenting machine 1. Since the striker bar 33 as depicted in the figures rests firmly upon the frame 31 structure of the releasable cradle 30, excessive shear force causing shearing of a shear pinned cradle assembly 30 to shear will also permit pivoting of the secured spacing blocks 92 and cradle assembly 30 away from the radial pathway $R_P$ of the shearing teeth 4 and, therefore, reduce the risk of costly damage to the fragmenting machine 1. The elevational height of the spacing blocks 92 determines the radial feeding positions of the adjustable feed and striker ramp 80. The more elevated positioning of the spacing blocks 92 will place the feed materials F in closer proximity to the radial pathway $R_P$ of the rotating shearing teeth 41 so as to provide a less aggressive angle of feed fragmentation by the shearing teeth 41.

With particular reference to FIGS. 10–13, the depicted two spacing blocks ($\mathbf{92}_A$ and $\mathbf{92}_B$) are equipped with a bolt receiving slots $\mathbf{91}_A$ and $\mathbf{91}_B$ for placement beneath the flanged member 85 and bolting thereto onto the leading edge $\mathbf{33}_L$ of the striker bar 33 with bolt 93 and nut 95 serve to rigidly anchor the spacer blocks $\mathbf{92}_A$ and $\mathbf{92}_B$ in cooperation with the under-footing support of carriage frame 31 at the appropriate ramping position. The leading edge of the striker bar 33 at the lateral crosswise ends of the striker bar 33 are provided with mating bolt receiving apertures (occluded from view) which permits the slotted spacing blocks $\mathbf{92}_A$ and $\mathbf{92}_B$ to be securely bolted to the striker bar 33 and maintained at the desired ramping elevation. The slotted spacing blocks 92 of differing heights allows for adjusting means 90 to be adjusted to desired ramping and striking position of the feed material F at the desired radial pathway $R_P$ of the breaking teeth 41. The spacing blocks $\mathbf{92}_A$ and $\mathbf{92}_B$ include a channeled groove $\mathbf{92}_G$ which permits spacing blocks $\mathbf{92}_A$ and $\mathbf{92}_B$ to rest flushly against release arms 33 and positioned at opposite sides of the cradle assembly 30. Excessive shearing forces shear the shear pins maintaining the release arms 33 and thereby allow the release arms 33 to swing downwardly and disengage the cradle assembly from the fragmenting zone 4.

Although the preferred embodiment of the invention depicted herein utilizes manually spacing blocks $\mathbf{92}_A$ and $\mathbf{92}_B$ of the appropriate elevating height positioned at opposite ends of the flanged member 85, other adjustable means 90 for elevating or de-elevating the adjustable ramp 80 may also be utilized to provide the appropriate feed positioning of feed ramp 80. For example, the flanged member 85 may include vertical bolt receiving slots, detent bolts and nuts which, when adjusted and bolted to the appropriate feed height and restraining position with underfooting shims (not shown) for maintaining the feeding ramp section 81 at the desired position, may then also be utilized to provide the desired feeding position of the feeding ramp section 81. Hydraulic or pneumatic controlled cylinders offer another alternative for providing adjusting means 90 for adjusting the feeding ramp 80 to the desired feed position. Other adjusting means 90 for adjusting the feeding ramp 80 to the desired ramping position include worm gears, ratching mechanism such as those commonly used to adjust the concaves of conventional agriculture grain combines and the like. Adjustable spacing blocks $\mathbf{92}_A$ and $\mathbf{92}_B$ of varying heights designed to abut onto frame 31, as illustrated in the drawings, are easy to install, inexpensive and provide a highly effective means for adjusting and maintaining the plate section 81 at the predetermined feed ramping position.

Figure 10:
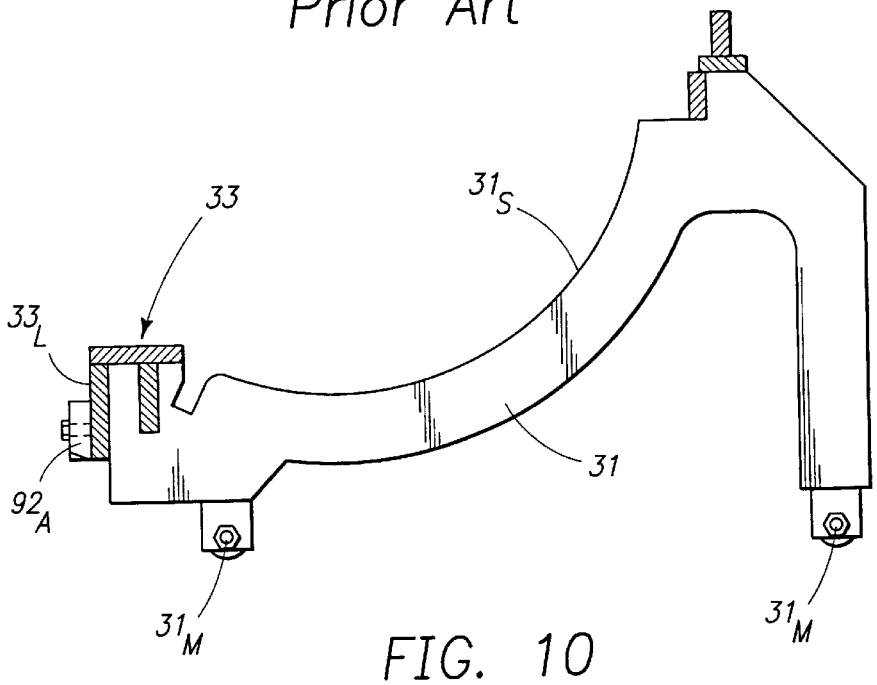
FIG. 10 is an isolated side view of a releasable cradle and striker bar assembly shown in part or in whole in FIGS. 2–5 and 8 with a detent spacing block bolted to the leading sidewall of a striker bar.
Figure 11:
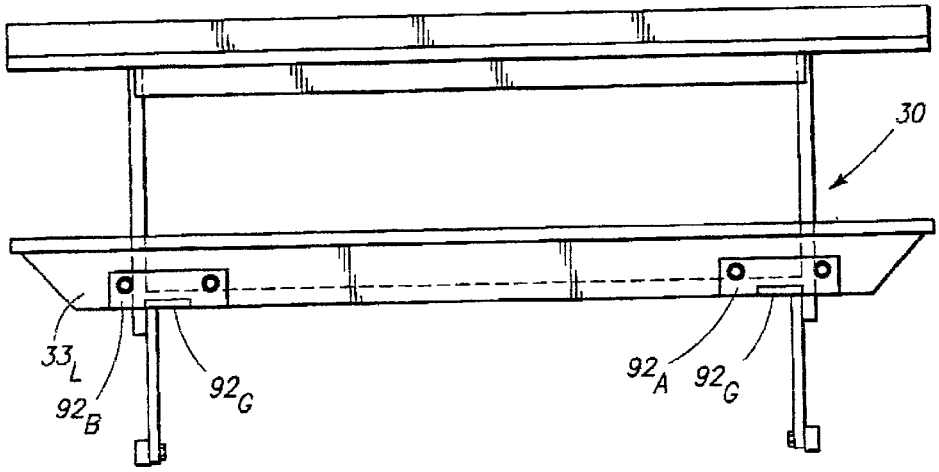
FIG. 11 is a frontal view of FIG. 10.
Figure 12:
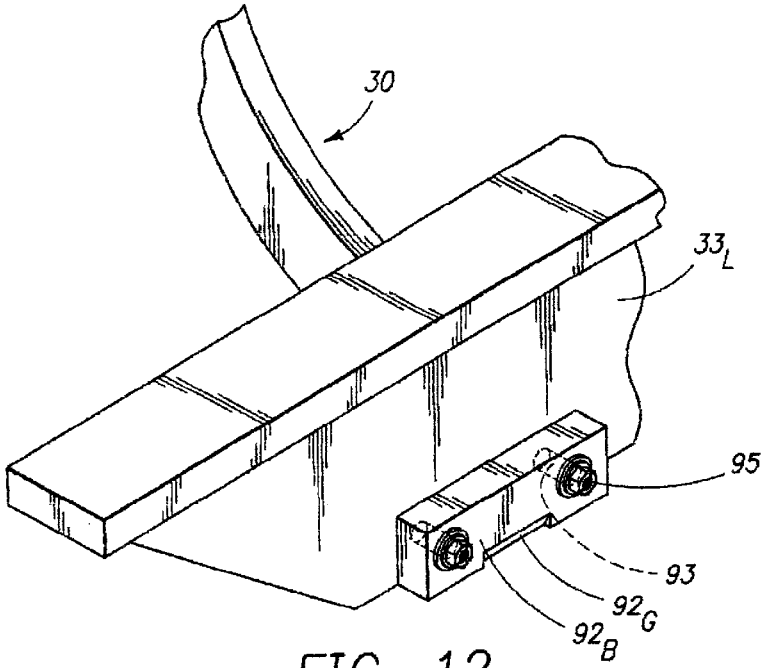
FIG. 12 is an enlarged prospective side view of FIG. 10.
Figure 13:
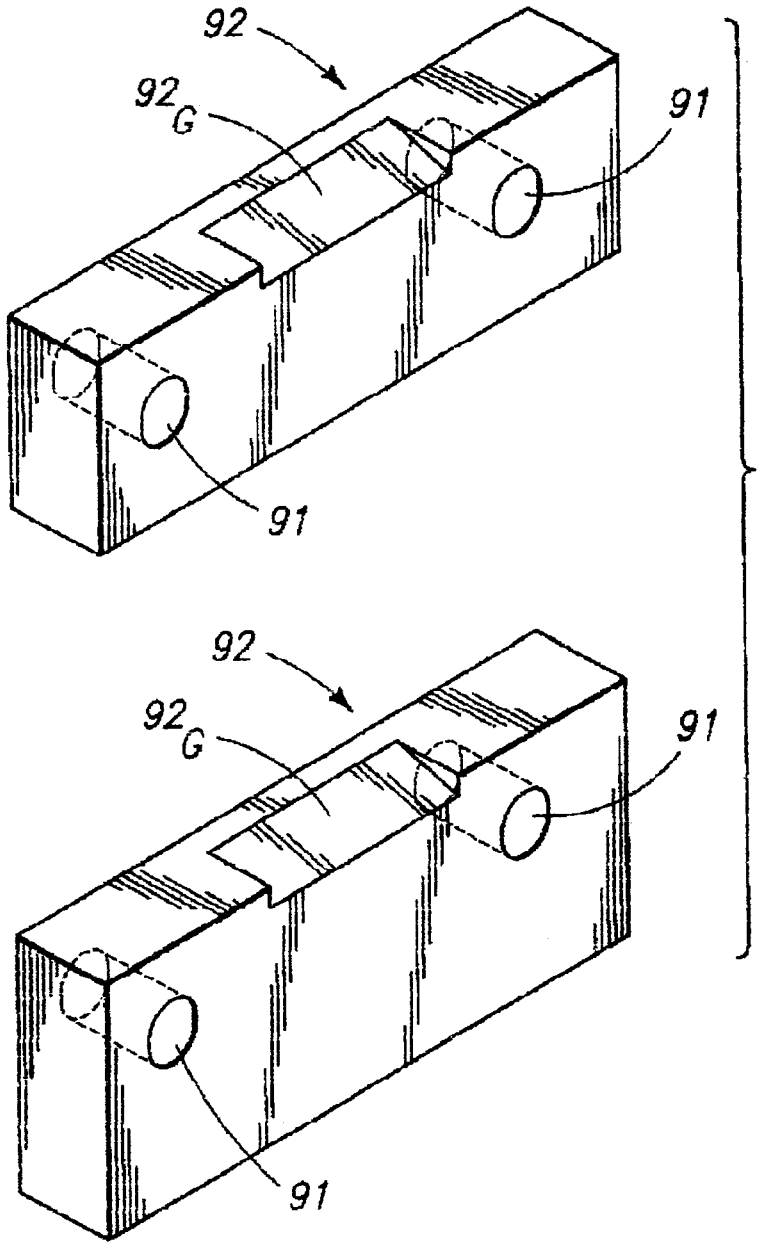
FIG. 13 is an isolated prospective view of spacing blocks of differing heights.

In another aspect of the invention there is provided an adjustable feeding and striking ramp assembly 80 which may be retrofitted onto a waste cycling device of the type disclosed in U.S. Pat. No. 5,975,443. In the retrofitting process, the releasable carriage assembly 30 is removed, as described in the aforesaid '443 Patent and illustrated by FIG. 14 therein. Mating holes $\mathbf{93}_O$ for bolting the elevating blocks to the striker bar 33, if not present for the detent bolts 93 of the detent spacing block $\mathbf{92}_A$ and $\mathbf{92}_B$, are drilled through the leading sidewall $\mathbf{33}_L$ on opposite ends of the striker bar 33 for anchoring of the detent spacing blocks $\mathbf{92}_A$ and $\mathbf{92}_B$ to the striker bar 33 and the releasable carriage assembly 30 as shown in FIGS. 10–12. In the retrofitting process and with reference to FIG. 9 herein, the discharging plate $\mathbf{15}_B$ is unhinged from hinging rod stock $\mathbf{15}_R$ and replaced with the hinged feeding and striking assembly 80 of the present invention as described and illustrated herein. The detent spacing blocks $\mathbf{92}_A$ and $\mathbf{92}_B$ are secured to provide the appropriate spaced clearance from the radial pathway $R_P$ of the rotating teeth 41 so as to provide optimum operational efficacy and freedom from machine fouling. In normal operation, it is desirable for the feed material F to be positioned at a level or somewhat higher relationship than the rotary action of the shearing teeth. In typical operational use the clearance between the radial pathway $R_P$ of the shearing teeth 41 and adjusted distal end of the ramped section 81 is more than 3.0 centimeters and usually more than about 3.25 centimeters. Closer tolerances may be used, but tend to hinder the effective flow of feed materials to the fragmenting rotor and breaking teeth.

The protective shell 18 or covering of the fragmenting machine 1 may be modified so as to provide quicker access for installing and removing the elevating means 90. For example, the sidewalls of the fragmenting machine 1 may be equipped with rod retaining ports (not shown) which when the discharging end of the feed ramp is raised and maintained at an installation position with a retaining rod placed beneath the feed ramp and bridging between the two retaining ports so as to maintain the ramp at an elevated position. Alternatively, the sidewalls of the fragmenting machine may be equipped with installing ports which permits the spacing blocks to be removed or installed onto the striker plate. A retaining rod may be used to retain the feed ramp in an elevated position while securing the spacing blocks to the striker bar.

What is claimed is:

1. In a fragmenting machine equipped with power feeding means for horizontally feeding feed materials onto a radial pathway of shearing teeth carried upon a rotating cylinder housed within a fragmenting zone and a screen for screening fragmented feed materials to a desired particle size, the improvement which comprises an adjustable feeding and striking ramp assembly for supporting an angular disposition of the feed material ramped onto the radial pathway of the shearing teeth, with said adjustable feeding and ramping assembly comprising a feeding and striking section pivotally mounted at a feed inlet end so as to permit an adjustable radially positioning of the feed materials upon the feeding and striking section for shearing by the shearing teeth as the feed materials are power fed onto the radial pathway of the shearing teeth and a detent spacer for elevating and maintaining the feeding and striking section at a desired radial positioning for feeding feed materials onto the radial pathway of the shearing teeth.

2. The improvement according to claim 1 wherein the detent spacer comprises a plurality of detent spacing blocks for elevating and maintaining the feeding and striking section at the desired radial positioning.

3. The improvement according to claim 1 wherein the detent spacer includes variable adjusting means for variably adjusting the feeding and striking section to the desired radial positioning.

4. The improvement according to claim 1 wherein the fragmenting machine includes a releasable cradle assembly supportively carrying a removable screen, a striking bar and the detent spacer being securely anchored to the cradle assembly in juxtaposition to the striking bar, with said releasable cradle assembly and said securely anchored detent spacer being releasable from a fragmenting position upon being subjected to an excessive shearing force.

5. A method for adjusting a radial positioning of feed materials power fed onto a radial pathway of shearing teeth rotating about a fixed axis of a rotor in a fragmenting zone of a fragmenting machine equipped to horizontally feed materials to an adjustably feeding and striking ramp assembly equipped to adjustably position the feed materials thereupon at a predetermined radial positioning for shearing by the shearing teeth as the feed materials are power feed to the fragmenting zone for fragmenting into fragmented pieces, by said method comprising:

a) ascertaining fragmenting characteristics of the feed materials to be power fed to the fragmenting zone;

b) adjusting the adjustable feeding and striking ramp assembly to the predetermined radial feed positioning for intercept onto the radial pathway of the shearing teeth so as to accommodate for the fragmenting characteristics of the feed materials and c) power feeding the feed materials to the fragmenting zone while maintaining the adjustable feeding and striking ramp assembly at the predetermined radial feed positioning for the shearing thereupon by the shearing teeth.

6. The method according to claim 5 wherein the feeding and striking ramp assembly includes a detent spacer for maintaining the adjustable feeding and striking ramp assembly at the predetermined radial feed position and the method includes securing the feeding and striking ramp assembly at the predetermined radial feed positioning with said detent spacer.

7. The method according to claim 6 wherein the feed material consists essentially of solid wood.

8. The method according to claim 5 wherein the feed material consists essentially of solid wood.

9. A method for altering the fragmentation of feed materials power fed onto a radial pathway of shearing teeth rotationally carried upon a rotating cylinder in a fragmenting zone while supporting the feed materials upon an adjustable feeding and striking ramp which serves to supportively and radially position the feed materials for striking by the shearing teeth and allows for an alteration of a radial feed positioning of the feed materials thereby supportively power fed onto the radial pathway of the shearing teeth, said method comprising:

a) adjusting the adjustable feeding and striking ramp to a desired radial feed positioning for the feed materials being power fed to the fragmenting zone; and b) fragmenting the feed materials power fed to the fragmenting zone while maintaining the feed materials at the desired radial feed positioning.

10. The method according to claim 9 wherein the method includes an additional step of readjusting the adjustable feeding and striking ramp to a second desired radial feed positioning so as to accommodate a different feed material being power fed to the fragmenting zone.

11. The method according to claim 10 wherein the adjusting includes securing a detent spacer to maintain the adjustable feeding and striking ramp at the desired radial feed positioning.

12. The method according to claim 10 wherein the detent spacer comprises a plurality of detent spacing blocks for elevating and maintaining the adjustable feeding and striking ramp at the desired radial feed positioning and the method includes the additional step of removing the detent spacing blocks from the releasable cradle assembly.

13. The method according to claim 10 wherein the method includes the additional step of readjusting the detent spacer so as to alter the radial feed positioning of feed materials fed to the radial pathway of the shearing teeth.

14. The method according to claim 13 wherein the feed material consists essentially of solid wood.

15. The method according to claim 9 wherein the feed materials consists essentially of solid wood.

16. In a fragmenting machine equipped with power feeding means for horizontally feeding feed materials onto a radial pathway of shearing teeth carried upon a rotating cylinder housed within a fragmenting zone, a releasable cradle assembly supportively carrying a removable screen for screening fragmented feed materials to a desired particle size, the improvement which comprises an adjustable feeding and striking ramp assembly for supporting an angular disposition of the feed materials ramped onto the radial pathway of the shearing teeth, with said adjustable feeding and ramping assembly comprising a feeding and striking section pivotally mounted at a feed inlet end serving as a supportive anvil for the feed materials fed onto the radial pathway of the shearing teeth and a detent spacer securely anchored to the cradle assembly for elevating and maintaining the feeding and striking section at a desired radial positioning for feeding feed materials onto the radial pathway of the shearing teeth, which releasable cradle assembly upon subjecting to an excessive shearing force releases the cradle assembly and the securely anchored detent spacer from a fragmenting position.

17. A method for altering the fragmentation of feed materials power fed onto a radial pathway of shearing teeth rotationally carried upon a rotating cylinder in a fragmenting zone with an adjustable feeding and striking ramp which serves as a supportive anvil and allows for an alteration of a radial feed positioning of the feed materials supportively fed onto the radial pathway of the shearing teeth and a releasable cradle assembly which upon subjection to excessive shearing forces disengages from the fragmenting zone, said method comprising:

a) adjusting the adjustable feeding and striking ramp to a desired radial positioning for the feed materials being fed to the fragmenting zone by securing a detent spacer to releasable cradle assembly to maintain the adjustable feeding and striking ramp at the desired radial feed positioning;

b) fragmenting the feed materials fed to the fragmenting zone while maintaining the feed materials at the desired radial positioning; and c) readjusting the adjustable feeding and striking ramp to a second desired radial feed positioning so as to accommodate a different feed material being fed to the fragmenting zone.

* * * * *